US007161482B2

(12) United States Patent
Rider et al.

(10) Patent No.: US 7,161,482 B2
(45) Date of Patent: Jan. 9, 2007

(54) INTEGRATED ELECTRONIC ARTICLE SURVEILLANCE AND PEOPLE COUNTING SYSTEM

(75) Inventors: William Matthew Rider, Port St. Lucie, FL (US); Harry Watkins, Boca Raton, FL (US); Scott Alan Tribbey, Coconut Creek, FL (US); David B. Fallin, Coral Springs, FL (US); John Jay Clark, Boynton Beach, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 63 days.

(21) Appl. No.: 10/828,041

(22) Filed: Apr. 20, 2004

(65) Prior Publication Data

US 2004/0239503 A1 Dec. 2, 2004

Related U.S. Application Data

(60) Provisional application No. 60/474,373, filed on May 30, 2003.

(51) Int. Cl.
*G08B 19/00* (2006.01)

(52) U.S. Cl. ..... 340/522; 340/539.1; 340/539.13; 340/573.1

(58) Field of Classification Search ..... 340/522, 340/539.1, 539.13, 573.1
See application file for complete search history.

(56) References Cited

U.S. PATENT DOCUMENTS

| | | | | |
|---|---|---|---|---|
| 5,708,423 | A | 1/1998 | Ghaffari et al. | |
| 6,255,946 | B1 | 7/2001 | Kim | |
| 6,396,413 | B1 * | 5/2002 | Hines et al. | 340/825.49 |
| 6,617,970 | B1 * | 9/2003 | Makiyama et al. | 340/573.1 |
| 6,698,653 | B1 * | 3/2004 | Diamond et al. | 235/375 |
| 7,019,644 | B1 * | 3/2006 | Barrie | 340/539.13 |
| 2002/0104013 | A1 | 8/2002 | Ghazarian | |
| 2003/0093305 | A1 * | 5/2003 | Davis et al. | 705/5 |

* cited by examiner

*Primary Examiner*—Daryl C Pope

(57) ABSTRACT

An integrated electronic article surveillance (EAS) and people counting system including an EAS system, a people counting system, and an alarm management unit. The alarm management unit accepts the EAS data signal from the EAS system and a people count signal from the people counting system for facilitating correlation of EAS and people count data. A method of monitoring a passageway and an alarm management unit associated with an integrated system are also provided. There is also provided a people counting system for determining a direction of travel of people including first and second people detection devices and a controller. The controller provides an output representative of a direction of travel in response to the outputs of the first and second people detection devices.

13 Claims, 4 Drawing Sheets

INTEGRATED ELECTRONIC ARTICLE SURVEILLANCE AND PEOPLE COUNTING SYSTEM

CROSS REFERENCE TO RELATED APPLICATIONS

The present application claims the benefit of the filing date of U.S. Provisional Application Ser. No. 60/474,373, filed May 30, 2003, entitled "Integrated Electronic Article Surveillance and People Counting System," the entire teachings of which are incorporated herein by reference.

FIELD OF THE INVENTION

The present invention relates to electronic article surveillance (EAS) systems and people counting systems and more particularly to an integrated EAS and people counting system.

BACKGROUND

EAS systems are utilized to protect assets by establishing an interrogation zone at an exit point of a protected area such as a retail store. The interrogation zone is established by an antenna or antennas positioned adjacent to the interrogation zone. The antenna(s) establish an electromagnetic field of sufficient strength and uniformity within the interrogation zone to detect an EAS marker attached to an asset to be protected.

When an article is properly purchased or otherwise authorized for removal from the protected area, the EAS marker is either removed or deactivated. If the EAS marker is not removed or deactivated, the electromagnetic field causes a response from the EAS marker in the interrogation zone. An antenna acting as a receiver detects the EAS marker's response indicating an active marker is in the interrogation zone. An associated controller provides an indication of this condition, e.g., an audio alarm, such that appropriate action can be taken to prevent unauthorized removal of the item from the protected area.

People counting systems provide a count of people entering and exiting a particular passageway or an establishment. A variety of people detection technologies are well known in the art. For instance, a people counting system may provide a beam, e.g., an infrared beam, across the passageway to be monitored. As people enter or exit the passageway the beam is temporarily interrupted. The people counting system detects this interruption and increments its internal count of people traversing the passageway.

Traditionally, EAS systems and people counting systems have been implemented as separate systems. The separate systems do not provide integration of data. As such, a host of data correlation and reporting functions between the systems cannot be readily accomplished.

In addition, there are a host of people counting systems that report on the direction of travel of people through a particular passageway. However, such people counting systems tend to be complex and expensive. For instance, one such directional counting system utilizes a foot activated pressure sensitive platform at the entry point of the passageway. Based on a pressure profile related to the engagement of an individual's foot with the platform, the system predicts the direction of travel of the individual.

There is, therefore, a need for an integrated EAS and people counting system that allows data mining through correlation of EAS and people counting data. There is also a need for a simple, inexpensive directional people counting system that overcomes the deficiencies in the prior art.

SUMMARY OF THE INVENTION

According to one aspect of the invention, there is provided an integrated electronic article surveillance (EAS) and people counting system. The system includes an EAS system, a people counting system, and an alarm management unit. The EAS system is configured to detect the presence of an active EAS marker in an interrogation zone of at least one passageway of an establishment and to provide an EAS data signal representative of EAS data. The people counting system is configured to count people who pass through the at least one passageway and to provide a people count signal representative of people count data. The alarm management unit accepts the EAS data signal and the people count signal for facilitating correlation of EAS and people count data.

According to another aspect of the invention, there is provided a method of monitoring at least one passageway including: providing EAS data to an alarm management unit from an EAS system associated with the at least one passageway; providing people count data to the alarm management unit from a people count system associated with the at least one passageway; and providing a correlated output signal in response to the EAS data and the people count data provided to the alarm management unit.

According to another aspect of the invention, there is provided an alarm management unit including a people counting system interface, an EAS system interface and an output interface. The people counting system interface is configured to accept a first signal representative of people count data from an associated people counting system. The EAS system interface is configured to accept a signal representative of EAS data from an associated EAS system. The output interface is configured to provide a correlated output signal based on the first and second signal.

According to another aspect of the invention, there is provided a people counting system for determining a direction of travel of people. The system includes first and second people counting devices and a controller. The first people detection device is configured to detect passage of people through an associated passageway and provide a first people detection signal. The second people detection device is mounted a predetermined distance from the first detection device and configured to detect the passage of people through the associated passageway and provide a second people detection signal. The controller is configured to receive the first and second people detection signals and provide an output representative of a direction of travel in response to the first and second people detection signals.

According to another aspect of the invention, there is provided a method of determining a direction of travel of people including: mounting a first people counting device a predetermined distance from a second people counting device; and determining the direction of travel based on which of the first people counting device and the second people counting system is triggered first.

BRIEF DESCRIPTION OF THE DRAWINGS

For a better understanding of the present invention, together with other objects, features and advantages, reference should be made to the following detailed description which should be read in conjunction with the following figures wherein like numerals represent like parts.

DETAILED DESCRIPTION

For simplicity and ease of explanation, the present invention will be described herein in connection with various exemplary embodiments thereof including an integrated EAS and people counting system. Those skilled in the art will recognize, however, that the features and advantages of the present invention may be implemented in a variety of configurations. For example, the present invention may be incorporated into a fixed or portable EAS device and/or people counting system. It is to be understood, therefore, that the embodiments described herein are presented by way of illustration, not of limitation.

Figure 1:
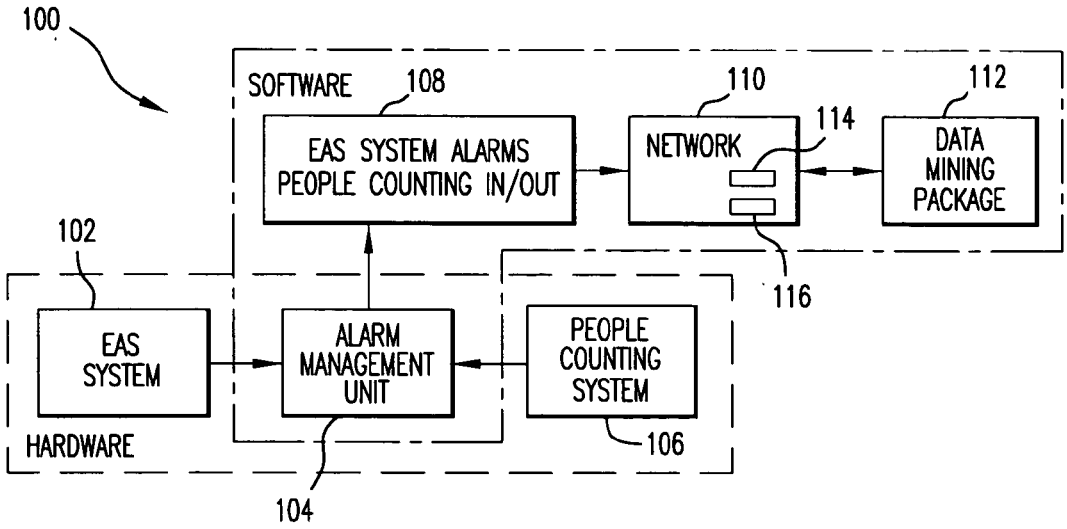
FIG. 1 is block diagram of an exemplary integrated EAS and people counting system consistent with the invention.

Turning to FIG. 1, a block diagram of an exemplary integrated EAS and people counting system 100 consistent with the invention is illustrated. In general, the integrated system 100 includes an EAS system 102, a people counting system 106, and an alarm management unit 104 that advantageously communicates with both the EAS system 102 and the people counting system 106 to enable further processing and correlation of EAS and people counting data. The alarm management unit 104 may further communicate such data 108 to an associated point of sale (POS) network 110 which may then utilize a data mining software package 112 to perform EAS and people counting data correlation as further detailed herein.

The EAS system 102 works in conjunction with EAS markers that are placed on assets to be protected. The EAS system 102 may be utilized in order to detect and modify the activation state of any type of EAS marker. Those skilled in the art will recognize that multiple types of EAS markers exist. The three most common types are electromagnetic (EM), Radio-Frequency (RF) and Acousto-Magnetic (AM). The three different types only work within their respective detection, activation, and deactivation systems. In addition, a variety of transmitter and receiver systems for exciting and detecting the presence of such markers are well known and commercially available. Accordingly, the basic methods of exciting and detecting such EAS markers will not be repeated here.

The people counting system 106 provides count data for people entering and exiting the protected establishment through one or more monitored passageways. Those skilled in the art will recognize various types of people detection and counting technologies that may be utilized in such a people counting system. For instance, a beam may be provided across a monitored passageway such that as people enter and exit the passageway, the beam is temporarily interrupted. The people counting system then correlates the number of beam interruptions with a count of persons traveling through the monitored passageway.

Advantageously, an alarm management unit 104 consistent with the invention accepts EAS data from the EAS system 102 and people count data from the people counting system 106. The EAS and people count data from the respective EAS system 102 and people counting system 106 may be stored in one or more databases 116 on the POS network 110. The data mining application 112 may then, via use of a main processor 114 of the POS network 110, analyze the EAS and people count data to perform a variety of EAS and people count data correlations as further detailed herein.

Figure 2:
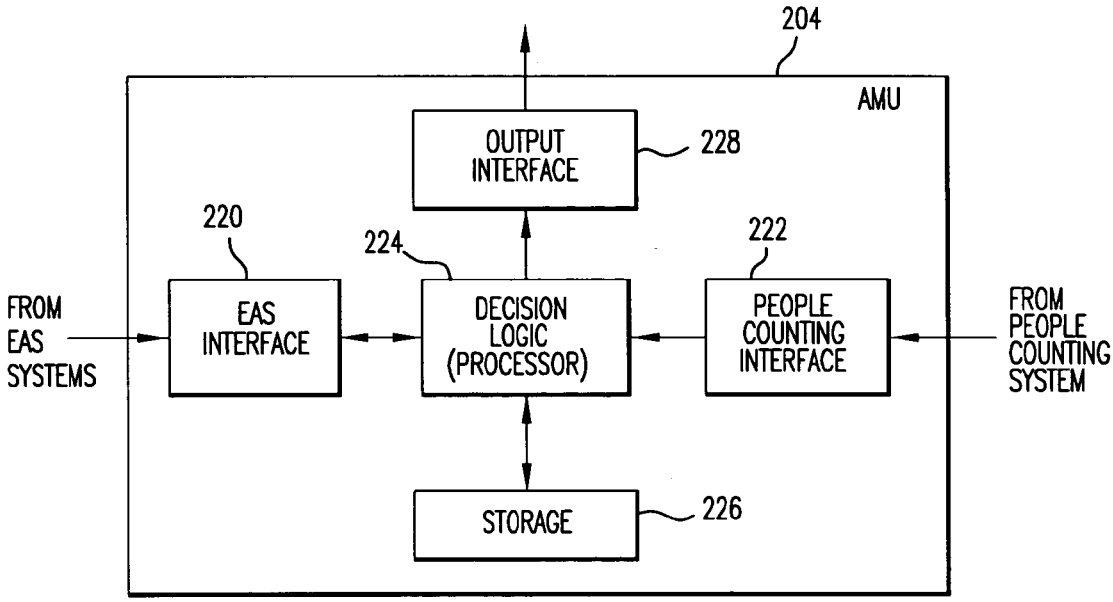
FIG. 2 is a more detailed block diagram of an exemplary alarm management unit that may be utilized in the system of FIG. 1.

Alternatively, as illustrated in FIG. 2, an alarm management unit 204 may store and process the EAS data and the people count data locally. For instance, an exemplary alarm management unit 204 may include an EAS interface 220, a people counting interface 222, a decision logic circuit 224, e.g., a pre-programmed processor or a state machine, for processing such data, storage 226 such as a machine-readable medium, and an output interface 228. The EAS interface 220 enables communication from the EAS system to and from the alarm management unit. Similarly, the people counting interface 222 enables communication from the people counting system 106. Such EAS and people count data may be stored in storage 226, e.g., in database format, for analysis by a database application program utilizing the processing power of the circuit 224.

Whether the data is stored and processed on the POS network 110, in the alarm management unit 204, or in another location, a variety of data correlation activities may take place. In addition, the output of the data correlation activities may be presented in a variety of fashions. For instance, such output may be video output, e.g., on a video screen of the alarm management unit 204 or of the POS network 110. Additionally or alternatively, the output may be an audio output and/or electronic data stored in an output file for later viewing and/or manipulation by a user of the integrated EAS and people counting system 100.

One exemplary data correlation function includes correlating EAS alarm data to the number of people who travel into or out of an establishment. For instance, such a data correlation may reveal that on average an EAS alarm occurs for every x number of people exiting the establishment. A loss prevention department of the associated establishment can then utilize this information in its security decision making. For instance, it may elect to more closely monitor exit areas when a heavy people traffic day has x number of people exiting the establishment over a shorter time interval, e.g., every hour.

Another exemplary data correlation function includes correlating EAS alarm data to the number of people who travel into or out of a particular passageway of an establishment. As such, any differences between passageways can be quantified and analyzed. Such analysis may reveal that a particular passageway has a higher incident of EAS alarms per a predetermined number of people exiting. Steps can then be taken to address that situation.

Yet another exemplary data correlation function includes correlating EAS alarm data to the total number of people occupying the establishment. The people counting system may be configured to not only count people but to count the total number of people who have entered and left the establishment, e.g., by having appropriate people counting devices at each passageway of the establishment. As such, the total number of people occupying the establishment at a given time can be ascertained. Data correlations may reveal that when the establishment has over a predetermined threshold of people in the store at any one time, e.g., when the establishment is crowded, an EAS alarm is y times more likely to occur than if the establishment has less then the predetermined threshold number of people. As such, loss prevention personnel may take precautionary steps such as increased passageway monitoring when the system 100 reports or indicates that the total number of people in the establishment is greater than the predetermined threshold.

Yet another exemplary data correlation function includes correlating the total number of people that exit during an EAS alarm event. For instance, once an EAS alarm occurs, the alarm management unit 104 may provide data indicative of the start time and stop time of the EAS alarm to the POS network 110. Over the same time interval defined by the start and stop time of the EAS alarm, the people counting system may provide people count data to the alarm management unit 104, which in turn provides such data to the POS network. The data mining application 112 may then ascertain how many people exited the establishment or a particular passageway during the particular EAS alarm event. A history of how many people exit the establishment or a particular passageway during an EAS alarm event may then also be developed.

In addition, the integrated EAS and people counting system 100 may also be utilized to assist in analyzing unexplained EAS alarms. For instance, the system 100 can provide data to indicate how many people entered or exited during an EAS alarm event. This will provide additional information to aid personnel in troubleshooting unexplained EAS alarms. For instance, if an EAS alarm was triggered when no person entered or exited, troubleshooting personnel can start to focus on other non person related reasons for the unexplained alarm, e.g., perhaps an EAS tag on a displayed asset is located in a display area too close to an antenna of the EAS system.

Figure 3:
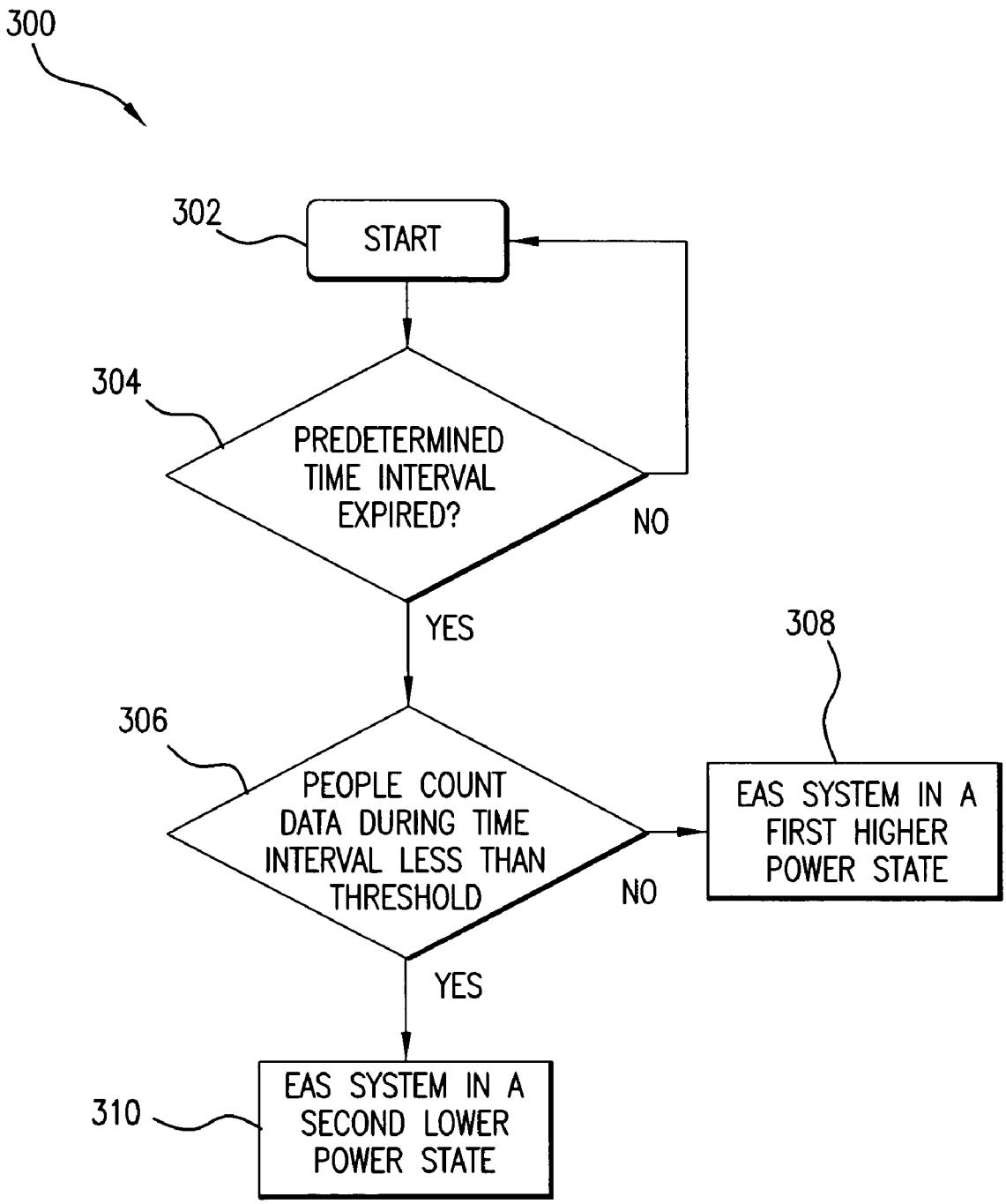
FIG. 3 is a flow chart of an exemplary EAS power management routine for the EAS system of FIG. 1 based on people count data from the people count system of FIG. 1.

The integrated EAS and people counting system 100 may also be utilized to provide for improved power management functions for the EAS system 102 based on people count data provided by the people counting system 106. FIG. 3 is a block flow diagram of a method 300 consistent with one exemplary embodiment of the invention for providing power management in a system consistent with the invention. The block flow diagrams used herein to describe various embodiments include particular sequences of steps. It can be appreciated, however, that the sequence of steps merely provides an example of how the general functionality described herein can be implemented. Further, each sequence of steps does not have to be executed in the order presented unless otherwise indicated.

In the illustrated exemplary method, once a predetermined time interval has expired 304, people count data over that time interval is ascertained and compared to a predetermined people count threshold level. This may be accomplished, for example, by the data mining application 112 and POS network 110 or directly by the alarm management unit 204. If the people count data is less than the people count threshold 306, then the EAS system is instructed to enter a second lower power state 310. If the people count data is not less than the predetermined people count threshold, then the EAS system is instructed or allowed to remain in a first higher power state 308. The EAS system consumes less power in the second lower power state then it does in the first higher power state. For instance, the EAS system 102 may turn off its transmitter in the second power state resulting in reduced power consumption.

The alarm management unit 104 or 204 may provide the control signal to the EAS system 102 indicating operation in the first power state or second power state. As such, the EAS system 102 consumes less power utilizing such a power management routine than it otherwise would if it constantly remained in the first power state. In addition, a wake up control signal may be provided to the EAS system 102 once the people counting system 106 indicates a predetermined number of people have entered or exited the establishment. This wake up control signal may be provided as soon as the people counting system 106 determines any one person has entered the establishment, or it may be provided once another predetermined people count is reached over a wake up time interval.

In addition, all the various data correlations between people count data and EAS data may be further correlated with other variables. For instance, one such variable may be time (time of day, day of the week, month, etc.). As such, people count and EAS correlations may be different depending on the time variable. For example, trends may reveal that an EAS alarm occurs for every x people exiting on Saturday and Sunday while an EAS alarm occurs only for every y people exiting the establishment on weekdays, where $x \ll y$. As such, the establishment may then elect to take greater security precautions on the weekends.

Figure 4:
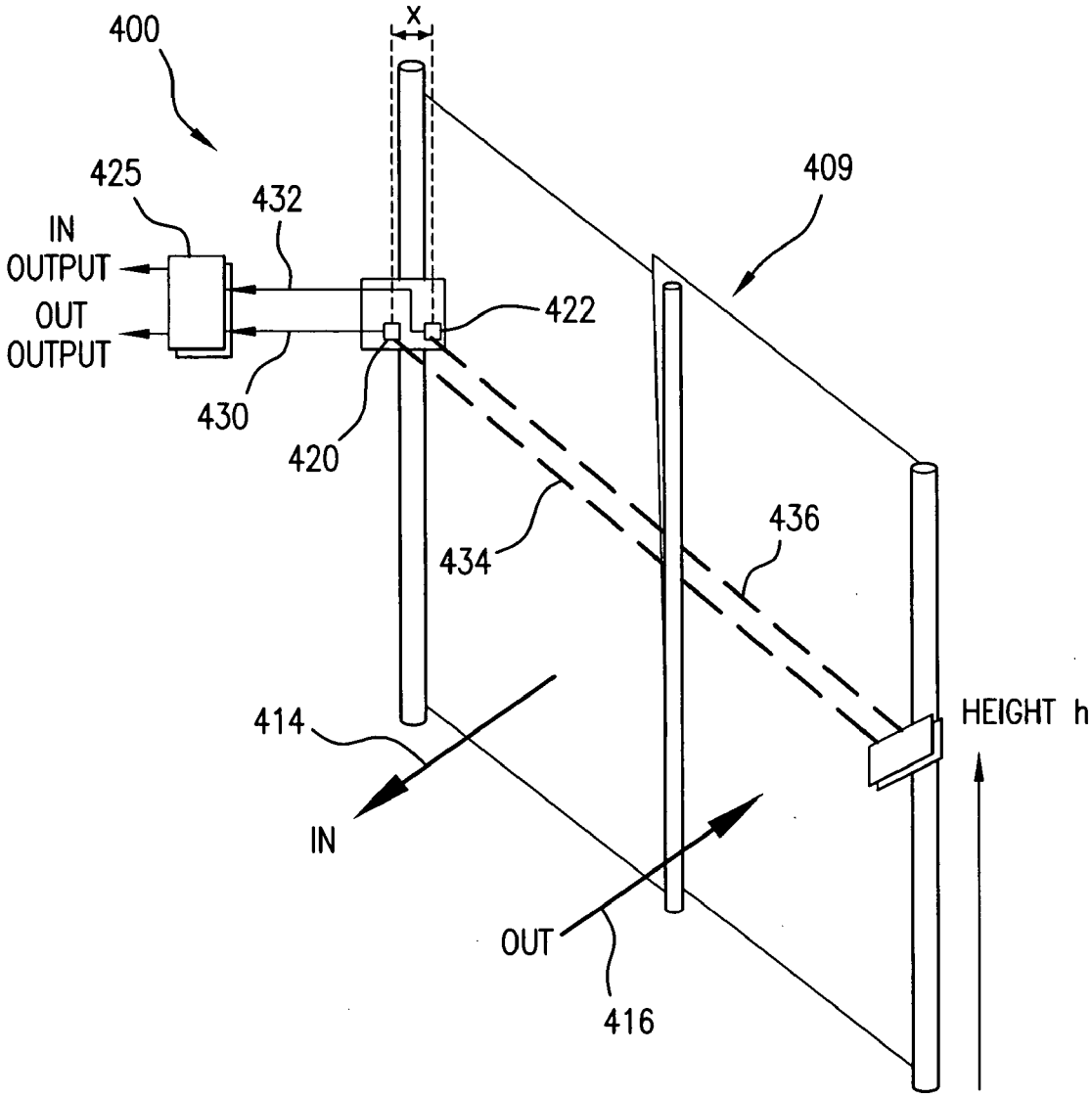
FIG. 4 is a perspective view of a passageway utilizing a pair of people detection devices in a configuration consistent with the invention for determining a person's direction of travel.

Turning now to FIG. 4, there is provided a perspective view of a people counting system 400 for detecting the number of people passing through passageway 409, as well as their direction of travel. The people counting system includes at least a first people counting device 420 and a second counting people device 422 separated by a distance x along a direction of travel by people entering or exiting the passageway 409. The outputs 430, 432 of the first 420 and second 422 people counting devices, respectively, may be provided to a controller 425 for analyzing the signals and providing a direction of travel based on such signals as further detailed herein.

The people counting devices 420, 422 may be commercially available people detection devices which alone are not capable of detection the direction of flow of people. For instance, the people detection devices 420, 422 may each provide a beam, e.g. 434, 436, respectively, at a height h from the floor. The beams 434,436 may be, for example, infrared beams, and the height h may be selected so that the beam will be interrupted when a person passes through the passageway 409.

In one exemplary mode of operation, when a detection device is triggered, i.e. either detection device 420 or 422 depending on the person's direction of travel, the triggered device may go into set mode. The first people detection device may remain in the set mode during the process of triggering the second people detection device. This may be accomplished by coordinating the set time with the separation distance x between the devices 420 and 422. With a typical set time, the separation distance x along the distance of travel may be between 0.25 inches and 12 inches, where 3.25 inches has been found to be nominal. When the second people detection device is triggered the system 400 may provide a signal indicative of an IN or OUT direction. If both devices 420 and 422 are continuously blocked, e.g., by a dwelling person, the people counting system 400 will not count such a dwelling person.

Figure 5:
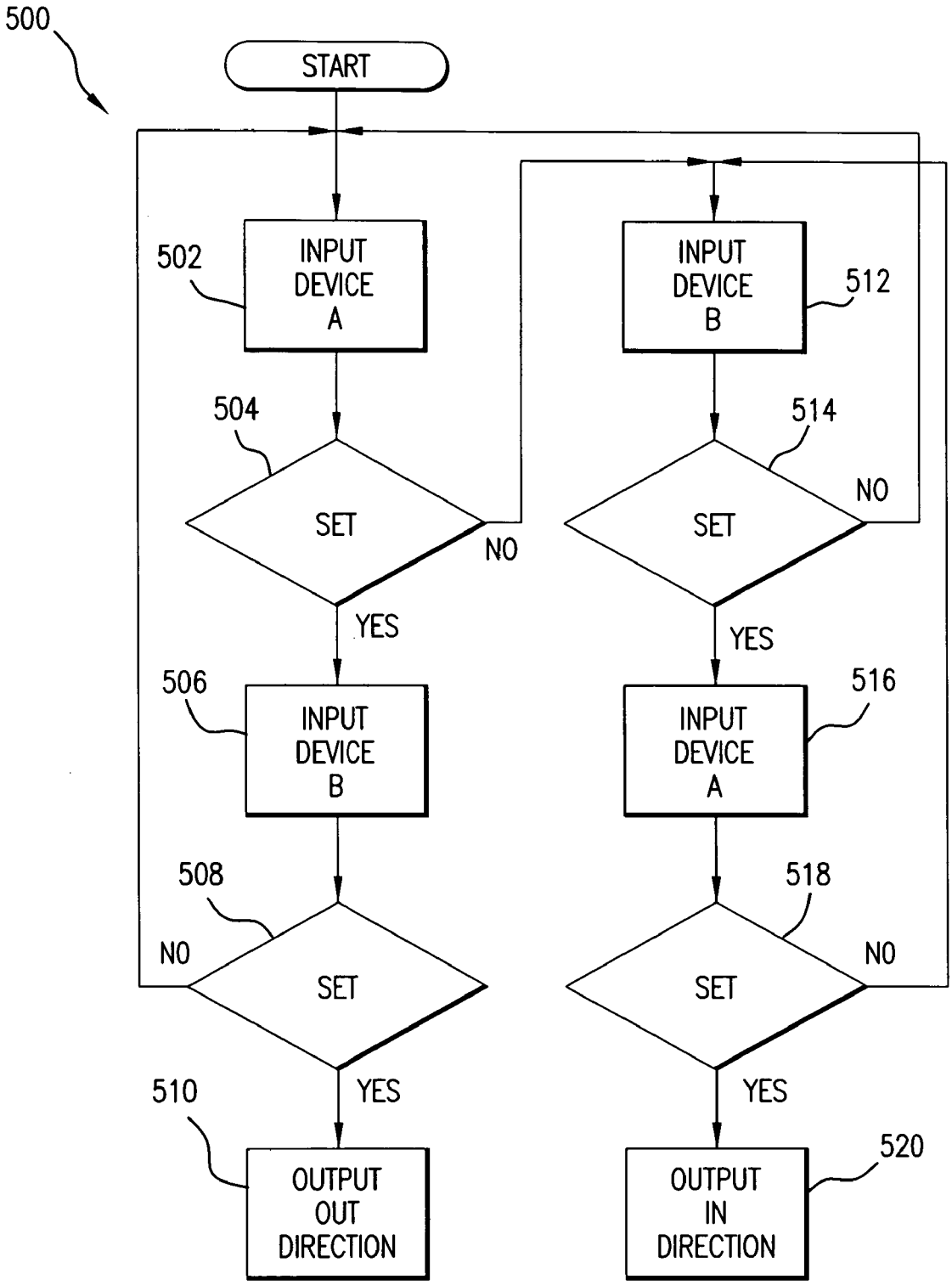
FIG. 5 is a flow chart of an exemplary algorithm for determining the direction of travel of a person detected by the people counting system of FIG. 4.

FIG. 5 is a block flow diagram of a method 500 consistent with one exemplary embodiment of the invention for determining direction of travel in a people counting system such as system 400. As shown, if a person is traveling in the Out direction, as indicated by Out arrow 416, the people detection device 420 will detect such person 502 and the system may be set 504 for a set time. If during this set time, people detection device 422 also detects a person 506 and is set 508, an output signal representative of a person traveling in the Out direction is provided 510. If a person is traveling in the In direction as indicated by In arrow 414, the people detection 422 will detect such person 512 will set 514 for a set time. If during the set time the people detection device 422 also detects a person 516 and is set 518, an output signal representative of a person traveling in the In direction 414 is provided 520.

There is thus provided a people counting system 400 that provides a directional of travel indication for associated person count data. The system 400 may be implemented using two or more existing people detection devices to provide for a simple, low cost, reliable, and easy to implement system.

It will be appreciated that the functionality described for the embodiments described herein may be implemented using hardware, software, or a combination of hardware and software, and well-known signal processing techniques. If implemented in software, a processor, e.g., circuit 224 or processor 114, and machine-readable medium is required. The processor can be any type of processor capable of providing the speed and functionality required by the embodiments of the invention. For example, the processor could be a processor from the Pentium® family of processors made by Intel Corporation, or the family of processors made by Motorola. Machine-readable media include any media capable of storing instructions adapted to be executed by a processor. Some examples of such media include, but are not limited to, read-only memory (ROM), random-access memory (RAM), programmable ROM (PROM), erasable programmable ROM (EPROM), electronically erasable programmable ROM (EEPROM), dynamic RAM (DRAM), magnetic disk (e.g. floppy disk and hard drive), optical disk (e.g. CD-ROM), and any other device that can store digital information. In one embodiment, the instructions are stored on the medium in a compressed and/or encrypted format.

As used herein, the phrase "adapted to be executed by a processor" is meant to encompass instructions stored in a compressed and/or encrypted format, as well as instructions that have to be compiled or installed by an installer before being executed by the processor. Further, the processor and machine-readable medium may be part of a larger system that may contain various combinations of machine-readable storage devices through various I/O controllers, which are accessible by the processor and which are capable of storing a combination of computer program instructions and data. There is thus provided an integrated EAS and people counting system to provide for automatic people count and EAS data correlations.

The embodiments that have been described herein, however, are but some of the several which utilize this invention and are set forth here by way of illustration but not of limitation. For example, various features and advantages described herein may be combined or used separately. It is obvious that many other embodiments, which will be readily apparent to those skilled in the art, may be made without departing materially from the spirit and scope of the invention.

What is claimed is:

1. An integrated electronic article surveillance (EAS) and people counting system comprising:

an EAS system configured to detect the presence of an active EAS marker in an interrogation zone of at least one passageway of an establishment and to provide an EAS data signal representative of EAS data;

a people counting system configured to count people who pass through said at least one passageway and to provide a people count signal representative of people count data; and an alarm management unit configured to accept said EAS data signal and said people count signal and to correlate said EAS data signal with said people count signal to provide a correlated output signal, said EAS system being configured to operate in a first power state and a second power state, wherein said EAS system consumes less power in said second power state than said first power state, and wherein said EAS system is configured to enter said second power state when said people count signal is representative of less than a first predetermined people count over a first predetermined time interval.

2. The system of claim 1, wherein said alarm management unit is further configured to cause storage of said EAS data and said people counting data.

3. The system of claim 2, further comprising a point of sale network, wherein said point of sale network comprises a processor for accessing a database, wherein said EAS data and said people count data are stored in said database.

4. The system of claim 1, wherein said correlated output signal is representative of a number of people through said at least one passageway per incident of an EAS alarm of said EAS system.

5. The system of claim 4, wherein said correlated output signal is representative of a number of people out of said at least one passageway.

6. The system of claim 1, wherein said correlated output signal is representative of a number of people through any of a plurality of passageways of said establishment per incident of an EAS alarm of said EAS system.

7. The system of claim 6, wherein said correlated output is representative of a number of people out of any of said plurality of passageways of said establishment.

8. The system of claim 1, wherein said correlated output is representative of a number of people occupying said establishment.

9. The system of claim 1, wherein said EAS system is configured to enter said first power state from said second power state if said people count signal is representative of a second predetermined people count over a second predetermined time interval.

10. A people counting system for determining a direction of travel of people, said system comprising:

a first people detection device configured to detect passage of people through an associated passageway and provide a first people detection signal;

a second people detection device configured to detect said passage of people through said associated passageway and provide a second people detection signal, said second people detection device mounted a predetermined distance from said first detection device; and a controller configured to receive said first and second people detection signals and provide an output representative of a direction of travel in response to said first and second people detection signals, said controller being configured to indicate a first direction of travel if said first signal is received a predetermined time interval before said second signal.

11. The system of claim 10, wherein said controller is configured to indicate a second direction of travel if said second signal is received a predetermined time interval before said first signal.

12. The system of claim 10, wherein said predetermined distance is between about 0.25 inches and 12.0 inches along said direction of travel.

13. A machine readable medium whose contents cause a computer system to perform a method of determining a direction of travel of people comprising:

receiving a first people count signal from a first people counting device and a second people count signal from a second people counting device, wherein said first people counting device is mounted a predetermined distance from said second people counting device; and determining said direction of travel based on which of said first people counting device and second people counting system is triggered first, said direction of travel being a first direction if said first people detection device is triggered first and said direction of travel is a second direction if said second people detection device is triggered a predetermined time interval before said first people detection device.

* * * * *